US009285715B2

(12) United States Patent
Gijsbrechts et al.

(10) Patent No.: US 9,285,715 B2
(45) Date of Patent: Mar. 15, 2016

(54) METHOD AND SYSTEM FOR REDUCTION OF CAKING

(71) Applicant: Xeikon IP BV, Eede (NL)

(72) Inventors: Dirk Marcel Constant Gijsbrechts, Melsele (BE); Werner Jozef Johan Op De Beeck, Putte (BE); Wim Libaers, Boortmeerbeek (BE); Lode Erik Dries Deprez, Wachtebeke (BE)

(73) Assignee: Xeikon IP BV, Eede (NL)

( * ) Notice: Subject to any disclaimer, the term of this patent is extended or adjusted under 35 U.S.C. 154(b) by 98 days.

(21) Appl. No.: 14/244,642

(22) Filed: Apr. 3, 2014

(65) Prior Publication Data

US 2014/0301756 A1 Oct. 9, 2014

(30) Foreign Application Priority Data

Apr. 5, 2013 (NL) ..... 2010581

(51) Int. Cl.
*G03G 15/11* (2006.01)
*G03G 15/10* (2006.01)

(52) U.S. Cl.
CPC ..... *G03G 15/11* (2013.01); *G03G 15/104* (2013.01)

(58) Field of Classification Search
CPC ..... G03G 9/08755; G03G 9/08797; G03G 9/08795; G03G 9/0804; G03G 9/0806; G03G 9/0825; G03G 15/104; G03G 15/11
USPC ..... 399/237, 238, 246, 248–250
See application file for complete search history.

(56) References Cited

U.S. PATENT DOCUMENTS

| | | | | |
|---|---|---|---|---|
| 5,515,141 | A | 5/1996 | Hanson | |
| 6,077,638 | A * | 6/2000 | Tanikawa et al. | 430/106.2 |
| 6,815,136 | B1 | 11/2004 | Zhao et al. | |
| 2003/0186157 | A1 * | 10/2003 | Teraoka et al. | 430/114 |
| 2005/0078984 | A1 * | 4/2005 | Fujita et al. | 399/249 |
| 2005/0160938 | A1 | 7/2005 | Moudry et al. | |
| 2006/0092212 | A1 * | 5/2006 | Kawamoto et al. | 347/22 |
| 2008/0019712 | A1 | 1/2008 | Tanaka et al. | |
| 2011/0103840 | A1 | 5/2011 | Oda et al. | |
| 2011/0217081 | A1 * | 9/2011 | Yoshie et al. | 399/238 |

FOREIGN PATENT DOCUMENTS

| | | |
|---|---|---|
| GB | 1353207 | 5/1974 |
| JP | S5879276 A | 5/1983 |
| JP | H04220498 A | 8/1992 |
| JP | H0744025 A | 2/1995 |

OTHER PUBLICATIONS

Haake Viscotester VT550, Aug. 1998, pp. 1-6.*
Search Report and Written Opinion in corresponding Dutch Application No. NL 2010581 dated Jun. 15, 2013 12 pages.
European Search Report in corresponding Application No. 14161752.2 dated Jul. 22, 2014 7 pages.

* cited by examiner

*Primary Examiner* — Walter L Lindsay, Jr.
*Assistant Examiner* — Jessica L Eley
(74) *Attorney, Agent, or Firm* — Andrew J. Anderson, Esq.; Harter Secrest & Emery LLP

(57) ABSTRACT

A method for the reduction of caking of excess liquid developer dispersion that remains present on the surface of a member after transfer of liquid developer dispersion from one member to another member in a digital printing apparatus, comprising the step of adding a dispersing composition to the excess liquid developer dispersion, wherein the dispersing composition comprises a dispersing agent.

19 Claims, 2 Drawing Sheets

METHOD AND SYSTEM FOR REDUCTION OF CAKING

FIELD OF THE INVENTION

This invention relates to a method and a system for reducing caking in liquid developer dispersion in a digital printing process.

BACKGROUND OF THE INVENTION

Liquid developer dispersions are known in the art and are used for electrophotography and developing electrostatic latent images formed on a latent image carrying member in a digital printing process. An example of such printing apparatus is provided in U.S. Pat. No. 7,995,953, the content of which is incorporated into this application in its entirety by reference.

A digital printing apparatus using liquid developer dispersion is often provided with means to collect excess liquid developer dispersion. Excess liquid developer dispersion is liquid developer dispersion that remains on a member and that is not transferred to the substrate during the printing process. The collected excess liquid developer dispersion can be recycled and can be reused. A problem of the known liquid developer dispersions is that the excess liquid developer dispersion remaining on the developer roll has a tendency to show caking. Caking is the formation of lumps in the dispersion resulting in a liquid where there is no uniform dispersion of the marking particles. Caking often results in an increase of viscosity of the liquid. Caking in liquid developer dispersion is the process where marking particles are no longer evenly dispersed in the carrier liquid and are not acting anymore as individual particles. Liquid developer dispersion that shows caking cannot be used for printing as such and needs to be treated first in order to re-obtain a homogeneously dispersed liquid toner which has similar conductivity and viscosity properties as the starting liquid developer dispersion. It is thought that caking is the result of marking particles that come so close into each other's neighborhood on the developing member, so that they start to feel each other's presence and start interacting with each other. Caking can also be the result of injecting charge and applying high shearing forces which are typically present when a thin layer of liquid developer dispersion passes through a very narrow gap between two members of the printing apparatus.

It is an object of the invention, amongst other objects, to provide excess liquid developer dispersion with reduced or no caking.

It is another object of the invention to reduce caking in excess liquid developer dispersion, so that it can be reused as such, or can be reused by applying only a small number of steps required for obtaining a homogenously dispersed liquid developer dispersion.

These objects, amongst other objects, are met at least partially, if not completely by various embodiments of this invention.

For example, these objects, amongst other objects, are met at least partially, if not completely by a method for the reduction of caking of excess liquid developer dispersion that remains present on the surface of a member after transfer of liquid developer dispersion from one member to another member in a digital printing apparatus, comprising the step of adding a dispersing composition to the excess liquid developer dispersion, wherein the dispersing composition comprises a dispersing agent. The dispersing agent is added with an amount that is sufficient to provide a reduction of caking

SUMMARY OF THE INVENTION

The inventors surprisingly found that by adding a dispersing composition to the excess liquid developer dispersion, the caking of the excess liquid developer significantly reduces. Furthermore, the inventors surprisingly found that by adding a dispersing composition to the excess liquid developer, the electrical conductivity and the viscosity of the excess liquid developer dispersion are similar to the viscosity and the electrical conductivity of liquid developer dispersion.

Without being bound to a theory, it is thought that the added dispersing agent in the dispersing composition adheres to the surface of the marking particles and tends to restore the dispersing properties of the dispersing agents already adhered on the marking particles. The dispersing agents that are already adhered on the marking particles seem to have lost the dispersing properties due to certain steps in the printing process. The steps that may be of influence on the dispersing properties are most likely a combination of the corona charger and/or discharger to charge/discharge marking particles in the liquid toner on the developer roller, and the fact that the liquid developer dispersion is forced to form a very thin layer on the members of the printing apparatus. Both steps may result in the dispersing agent being rearranged on the marking particles, causing the caking phenomenon. In this respect it is important to note that there is a difference between the dispersing agents already adhered on the marking particles in the liquid developer dispersion, and the dispersing agent in the dispersing composition according to the invention that is added in the method according to the invention. The dispersing agent that is already adhered to the marking particle is added at the time of manufacturing liquid developer dispersion. Then, marking particles, dispersing agent and carrier liquid are milled whereupon the dispersing agent adheres to the marking particles to form a homogenous dispersion according to techniques known in the art.

The dispersing composition according to the invention comprises dispersing agent with an amount that is sufficient to reduce caking in excess liquid developing dispersion.

In one embodiment the dispersing composition according to the invention comprises dispersing agent that is free in the composition, wherein the free dispersing agent is present in an amount that is sufficient to be capable of reducing caking by adding dispersing composition to excess liquid developer dispersion. In a possible embodiment illustrated in FIG. 1A, the dispersion composition comprises only free dispersing agent, i.e. only dispersing agent not residing on particles. In other embodiments the dispersing composition can comprise both free dispersing agent as well as dispersing agent adhered to particles, see FIG. 1B. If the dispersing composition comprises particles, such as marking particles or other particles, on which the dispersing agent resides, the dispersing composition also comprises dispersing agent that is free, wherein the amount of free dispersing agent is sufficient to be capable of reducing caking in excess liquid developing dispersion.

The free dispersing agents can form a micelle in the composition. Preferably, the dispersing composition is a mixture of a dispersing agent and a carrier liquid.

In this invention, "dispersing agent", can refer to one type of dispersing agent or also to a combination of several dispersing agents.

According to the invention, a liquid developer dispersion comprises marking particles, carrier liquid and dispersing agent. It may also comprise further compounds such as compounds for arranging the viscosity or charge control agent (CCA), charge enhancing agents (CEA), wax, and other additives.

In this invention, a concentration of "liquid developer dispersion" refers to a concentration wherein the liquid developer dispersion has a solid content so that it can be used as such in a digital printing process. In other words, the liquid developer dispersion according to the invention has a solid content that is at working strength and does not require a dilution. On the contrary, "concentrated liquid developer dispersion" has a solid content which is too high to be used for printing and is generally diluted with carrier liquid to obtain a liquid developer dispersion which is ready to be used in a digital printing process. A typical solid content of a liquid developer dispersion is a solid content of between 10 to 30 wt %, such as a solid content of 25 wt %.

According to this invention, "solid content" means the amount of marking particles in wt % with regard to the total liquid developer dispersion.

According to this invention, "excess liquid developer dispersion" is the liquid developer dispersion that remains present on the surface of a member, such as the developing member, after a part of liquid developer dispersion has been transferred to another member, such as the imaging member. The concentration of toner particles (solid content) in excess liquid developer dispersion will vary depending on the amount of marking particles that need to be developed. The two most extreme situations of developing are that all the liquid developer dispersion is developed, or none of the liquid developer dispersion is developed. The latter results in a substrate without printed image. When no liquid developer dispersion is developed and all the marking particles remain on the developing member and thus reside in the excess liquid developer dispersion, the solid content is higher than in the liquid developer dispersion. On the contrary, if all the liquid developer dispersion is developed, the excess liquid developer dispersion remaining on the developer roller will comprise almost no marking particles resulting in an excess liquid developer dispersion that mainly comprises carrier liquid. A person skilled in the art will understand that the solid content and the concentration of the carrier liquid in the excess liquid developer dispersion will vary between these two extremes depending on what needs to be developed. Typically, during the printing process a certain amount of carrier liquid is lost. Typically, the viscosity of the excess liquid developing dispersion is increased compared to the viscosity of liquid developing dispersion. The increase of the viscosity is due to the loss of carrier liquid and due to caking. Caking causes a structural change in the liquid developing dispersion and has a significant contribution to the increase of viscosity of the excess liquid developer dispersion.

A concentration of dispersing agent or another compound in excess liquid developing dispersion in wt %, in accordance with this invention is intended to refer to a concentration of dispersing agent or another compound compared to the weight of excess liquid developing dispersion that remains on the member of the carrier liquid, unless it is clear that something else is meant.

The marking particles, according to this invention, comprise colored particles (also called ink particles or pigment) and a binder resin. The binder resin is a polymer, preferably transparent, that embeds the ink particles and optionally other compounds. The marking particles are particles with a diameter of typically about 0.5 to 4.0 μm. The marking particles have a concentration of about 40-95% of the binder resin. Preferably a polyester resin is used as binder resin. Also other types of resin having a very low or no compatibility with the carrier liquid and dispersing agent can be used. Preferably, the resin has a high transparency, provides good color developing properties and has a high fixing property on the substrate.

The carrier liquid according to the invention can be any suitable liquid as is known in the art, and may be silicone fluids, hydrocarbon liquids and vegetable oils, or any combinations thereof.

According to the invention, the dispersing composition is added to excess liquid developing dispersion. Excess liquid developing dispersion is the liquid that resides on or has been removed from a member, such as a development member, after a part of liquid developing dispersion has been transferred to another member, such as the imaging member.

In one embodiment, the dispersing composition is added after excess liquid developing dispersion has been removed from the member on which the excess liquid developer dispersion resides and collected.

In another embodiment, the dispersing composition is added before excess liquid developing dispersion is removed from the member on which the excess liquid developer dispersion resides.

In yet another embodiment, the dispersing composition is added before and after excess liquid developing dispersion has been removed from the member on which the excess liquid developer dispersion resides and collected.

In one embodiment according to the invention, the dispersing agent in the dispersing composition is added with an amount that is sufficient to obtain a concentration of between 0.005 wt % and 0.5 wt %, preferably between 0.01 wt % and 0.3 wt %, and most preferably between 0.02 wt % and 0.2 wt % of added dispersing agent with regard to the total weight of excess liquid developer dispersion. The inventors surprisingly found that adding such a small amount of dispersing agent is sufficient to reduce caking of excess liquid developer dispersion, and is able to restore the viscosity and conductivity of the excess liquid developer dispersion to a conductivity and viscosity which is roughly the same as that of liquid developer dispersion.

In another embodiment, the invention is related to a method wherein the dispersing agent in the dispersing composition is selected from the group consisting of polymeric dispersing agents with a polyethylenimine or polyallylamine backbone and polyhydroxystearate and/or polycaprolactone grafts; statistical copolymer of vinylpyrrolidone and long chain olefins. Typical examples of dispersing agents are solsperse 11000, solsperse 13940 solsperse 11200, Antaron V220, Ajispers 817, tilosperse 8300 or tilosperse 13000. Preferably the dispersing agent is solsperse 13940.

In yet another embodiment, the invention is related to a method wherein the amount of the dispersing agent in the dispersing composition that is added is sufficient to decrease a viscosity of the excess liquid developer dispersion.

In yet another embodiment, the invention is related to a method wherein the viscosity of the treated excess liquid developer dispersion is between 1.1 and 25 times lower, preferably between 1.5 and 15 times lower and most preferably between 2 and 10 times lower compared to the viscosity of untreated excess liquid developer dispersion, when the viscosity is measured at 25° C. at a shear rate of 0.88 l/s. As example the viscosity of the liquid developer dispersion and carrier liquid is measured with a Haake Rheostress RS600 whereby the instrument is equipped with a cone/plate geometry type C60/1° and the gap is set to 0.052 mm.

In yet another embodiment, the invention is related to a method comprising the step of collecting excess liquid developer dispersion.

In yet another embodiment, the invention is related to a method further comprising the step of mixing the collected excess liquid developer dispersion with dispersing composition by suitable mixing means.

In yet another embodiment, the invention is related to a method also comprising the step of determining an amount of dispersing composition to be added to reduce caking of excess liquid developer dispersion, wherein the adding comprises adding the determined amount. In further developed embodiments the determining of an amount to be added may be based on a measurement of the viscosity of the excess liquid developer dispersion and/or on image information.

In yet another embodiment, the invention is related to a method wherein the dispersing composition consists of dispersing agent or a combination of dispersing agents.

In yet another embodiment, the invention is related to a method wherein the dispersing composition consists of a mixture of dispersing agent or a combination of dispersing agents and a carrier liquid.

According to a further developed embodiment of the method of the invention, image information about an image that is being printed in the digital printing apparatus is collected, wherein the image information is representative for the fraction of liquid developer dispersion that is being developed. The amount of dispersion composition to be added is determined based on the collected image information, and the determined amount of dispersion composition is added.

Such embodiments are based inter alia on the insight of the inventors that the liquid toner properties, such as the viscosity and electrical conductivity, of the remaining non used excess liquid developer dispersion are a function of the amount of toner and/or liquid used during the development process. When no image has been developed only carrier liquid with a small amount of dispersing agent is transferred from the development member to the imaging roller. In a situation where a full density over the complete width has been developed, mostly only carrier liquid remains of the surface of the development roller. More in particular, the inventors have realized that the concentration of the dispersing agent in the excess liquid developer dispersion will be a function of the coverage of the developed image: a larger developed area leads to less reduction in dispersing agent concentration. In other words, using the image information, a suitable amount of dispersion agent to be added can be determined.

According to another aspect of the invention there is provided a digital printing system comprising a first member in rotational contact with a second member; the first and second member being configured for transferring liquid developer dispersion from the first member to the second member, such that an excess liquid developer dispersion remains present on the surface of the first member after transfer of liquid developer dispersion to the second member. The system further comprises adding means configured for adding an amount of dispersing agent to the excess liquid developer dispersion, and control means for controlling the adding means such that the amount added is sufficient to reduce caking in the excess liquid developer dispersion.

Preferably, the control means are configured for controlling the adding means such that the amount added is sufficient to decrease the viscosity of the excess liquid developer dispersion.

Preferably, the control means are configured for controlling the adding means such that the amount added is sufficient the obtain a viscosity of treated excess liquid developer dispersion that is 1.1 and 25 times lower, preferably between 1.5 and 15 times lower, and most preferably between 2 and 10 times lower compared to the viscosity of untreated excess liquid developer dispersion, when the viscosity is measured at 25° C. at a shear rate of 0.88 l/s.

According to a further developed embodiment the system further comprises collecting and determining means configured for collecting image information about an image that is being printed in the digital printing system, wherein the image information is representative for a fraction of liquid developer dispersion that is being developed on the development roller; and for determining an amount of dispersion agent to be added based on the collected image information. In addition, the control means may be configured for controlling the adding means using the determined amount of dispersion agent to be added.

According to a preferred embodiment the second member is an imaging member adapted to sustain a pattern of electric charge forming a latent image on its surface; and the first member is a development member arranged to receive a quantity of liquid developer dispersion, and to develop the latent image by transferring a portion of the quantity of liquid developer dispersion onto the imaging member in accordance with the pattern. The image information as defined above is directly related to the pattern and is a measure for the fraction of developer dispersion that is being developed.

According to yet another embodiment, the system comprises a viscosity sensor arranged for measuring the viscosity of the excess liquid developer dispersion. The controller may then be configured for controlling the adding means based on the measured viscosity. Alternatively or in addition, the system comprises a conductivity sensor arranged for measuring the conductivity of the excess liquid developer dispersion, wherein the controller is configured for controlling the adding means based on the measured conductivity.

According to a preferred embodiment, the digital printing system comprises a first reservoir adapted for collecting the excess liquid developer solution, wherein the adding means are arranged for adding an amount of dispersing agent in the first reservoir. This first reservoir is typically relatively small and may be provided with a suitable mixing means for mixing the excess liquid developer solution with an amount of dispersing agent. The system further comprises a second reservoir, typically larger than the first reservoir, adapted for mixing the excess liquid developer solution in which the amount of dispersing agent is added, with carrier liquid and/or toner concentrate. To that end there are provided carrier liquid adding means arranged for adding an amount of carrier liquid in the second reservoir, and toner concentrate adding means arranged for adding an amount of toner concentrate in the second reservoir. Typically, the second reservoir is connected to the main reservoir for returning recycled developer dispersion to a main reservoir comprising a feeding means for feeding a developer roller. Such a system has the advantage that caking in the collected excess liquid developer dispersion can be adequately addressed in the first reservoir, whilst the solid content can be brought to a suitable level in the second reservoir.

BRIEF DESCRIPTION OF THE SEVERAL VIEWS OF THE DRAWINGS

The above generally describes the invention but to assist with understanding, reference will now be made to the figures and non-limiting examples which show embodiments of the invention.

DETAILED DESCRIPTION OF THE INVENTION

Figure 1A:
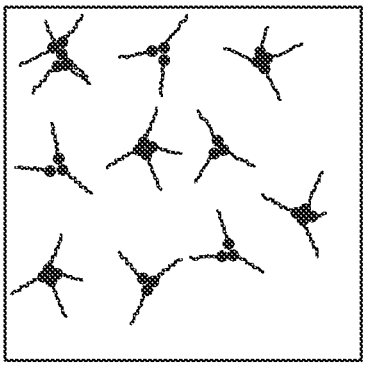
FIGS. 1A and 1B represent a dispersing composition according to the invention with FIG. 1A representing the composition without particles and FIG. 1B representing the composition with particles.
Figure 1B:
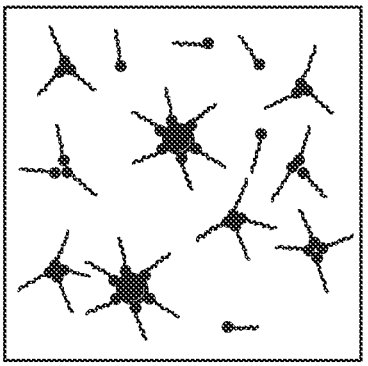

FIGS. 1A and 1B illustrate schematically a dispersing composition according to the invention. The dispersing agent is represented by little circles with a coil. Particles are represented with dark balls. The grey area represents liquid in which dispersing agent and/or marking particles reside. FIG. 1A represents dispersing composition without particles; FIG. 1B represents dispersing composition with particles.

Figure 2:
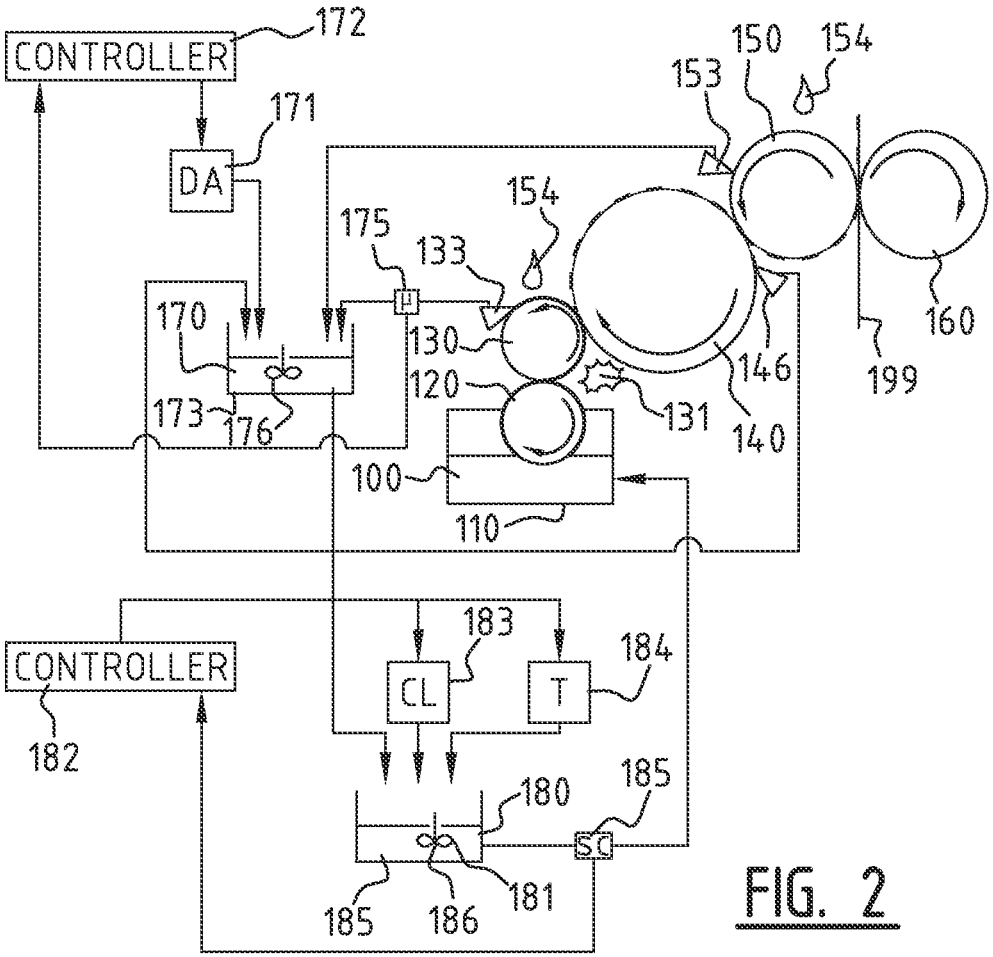
FIG. 2 is a schematic diagram of a system according to a first embodiment of the present invention.

FIG. 2 schematically illustrates the application of an amount of liquid developer dispersion 100, initially stored in a liquid developer dispersion reservoir 110, also called main reservoir, via a toner supply member 120, a development member 130, an imaging member 140, and an optional intermediate member 150, to a substrate 199. Without loss of generality, the aforementioned members are all illustrated and described as rollers. The development member 130, imaging member 140, and intermediate member 150 all transfer part of the liquid developer dispersion 100 adhering to their surface to their successor; the part of the liquid developer dispersion 100 that remains present on the member's surface, thus the excess liquid developer dispersion is removed after the transfer stage by appropriate means. These means are schematically illustrated as respective removal means 133, 146, 153.

The excess liquid developer dispersion removed by scraper 133 is added to a first reservoir 170. Optionally the excess liquid developer dispersion removed by scrapers 146 and 153 may be added to the same reservoir 170. Alternatively there may be provided separate reservoirs/lines for the collection of excess liquid developer dispersion removed by scrapers 146 and 153. Dispersing composition comprising free dispersing agent (DA) is added to the first reservoir 170 using DA adding means 171. The DA adding means 171 may be controlled by a controller 172 configured to determine a suitable amount of dispersion composition to be added. Optionally there may be provided a viscosity sensor 175 to determine the viscosity of the excess liquid toner dispersion 173, and the controller 172 may be configured to determine the amount to be added based on the viscosity measured by the sensor 175. Alternatively or additionally, the controller may be configured to determine the amount to be added based on image information (not illustrated in FIG. 2).

In the illustrated embodiment the sensor 175 is provided in the line between the scraper 133 and the reservoir first 170. Alternatively or in addition, a viscosity sensor could be provided in the line between the first reservoir 170 and a second reservoir 180 or in the line between the second reservoir 180 and the main reservoir 110. Also there may be provided more than one viscosity sensor 175, in order to further improve the control accuracy.

Optionally dispersing composition and/or carrier liquid may be added to the excess liquid developer dispersion before being removed, see reference numeral 154.

Optionally the collected excess liquid developer dispersion 173 is mixed using a suitable mixing means 176. Next, the excess liquid developer dispersion with added dispersion agent is introduced in a second reservoir 180 having a larger volume than the first reservoir 170 and comprising a suitable mixing means 186. In the exemplary embodiment of FIG. 2, the second reservoir 180 is used for bringing the solid content (SC) of the excess liquid developer dispersion on a suitable level for reintroduction in the main reservoir 110. To that end there are provided carrier liquid adding means 183 and toner adding means 184. The solid content is measured using a solid content sensor 185 in the line between the second reservoir 180 and the main reservoir 110, and there is provided a controller 182 to control the amount of carrier liquid and the amount of toner concentrate to be added based on the measured solid content.

According to a non-illustrated embodiment there may be provided one or more conductivity sensors to measure the conductivity of the excess liquid developer dispersion. Those one or more conductivity sensors may be provided at the same locations defined above for the viscosity sensor. In such an embodiment the controller may further take into account the conductivity measurements to determine the amount of dispersing agent to be added.

According to a non-illustrated further embodiment there may be provided a single mixing reservoir in which dispersion composition, carrier liquid and toner concentrate are separately added using dispersing composition adding means, carrier liquid adding means and toner adding means, respectively. Also in such an embodiment a viscosity sensor may be added to measure the viscosity of the excess liquid developer dispersion, preferably before it is introduced in the reservoir. Again this measurement may be used by a controller for controlling the added amount of dispersing composition.

Figure 3:
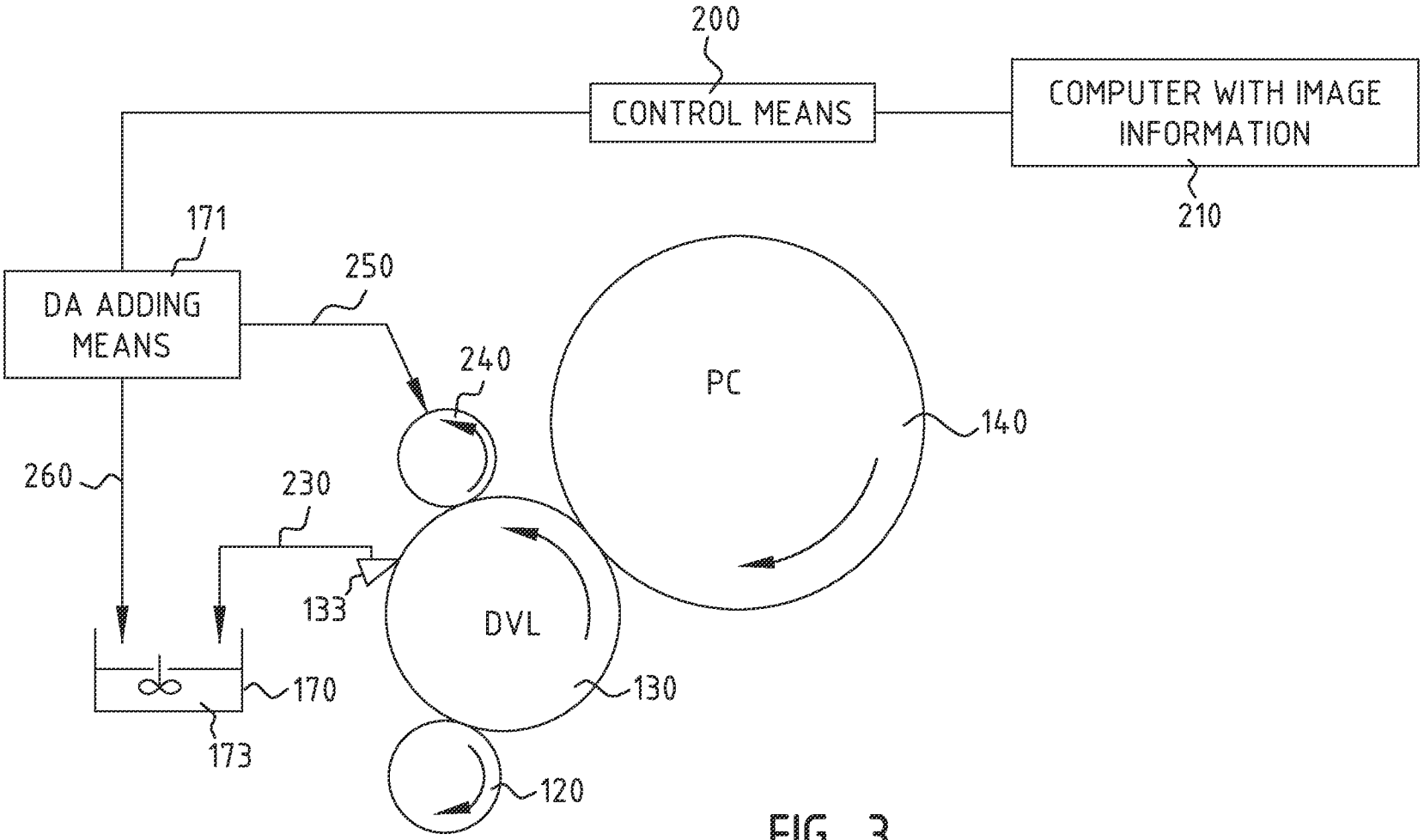
FIG. 3 is a schematic diagram of a system according to a second embodiment of the present invention.

FIG. 3 illustrates a second embodiment of a digital printing system of the invention. The system comprises an imaging member 140 adapted to sustain a pattern of electric charge forming a latent image on its surface, and a development member 130 arranged to receive a quantity of liquid developer dispersion from a feed roller 120, and to develop the latent image by transferring a portion of the quantity of liquid developer dispersion onto the imaging member 140 in accordance with the pattern, such that an excess liquid developer dispersion remains present on the surface of the development member. This excess liquid developer dispersion is removed by a scraper 133 and added to a mixing container 170, see arrow 230. The system further comprises DA adding means 171 configured for adding an amount of dispersing composition to the excess liquid developer dispersion 173, and control means 200 for controlling the adding means such that the amount added is sufficient to reduce caking in the removed excess liquid developer dispersion. The control means may receive image information, directly related to the pattern sustained on the imaging member 140, from a computer 210 in order to control the imaging member 140 as well as the adding means 171. Preferably, the control means 200 are configured for controlling the DA adding means 171 such that the amount of dispersion agent added is sufficient to decrease the viscosity. The image information is representative for a fraction of liquid developer dispersion that is being developed on the development roller; and is used to determine an amount of dispersion agent to be added. In the embodiment of FIG. 3 the computer 210 may obtain the image information in function of the time and calculate an amount of dispersion agent to be added in function of the time.

Also a loosening roller/member 240 to reduce caking may be provided downstream of the area of contact between the developer roller and the imaging roller, as disclosed in European Patent Application Publication No. EP 2685322 in the name of the Applicant, the content of which is included herein by reference. According to an embodiment of the invention the dispersing agent may be added on such a loosening roller/member, see arrow 250. In that case the adding of dispersion agent (arrow 260) in the container 170 may be omitted.

Optionally there may be provided a (non-illustrated) viscosity sensor to measure the viscosity of the excess liquid developer dispersion. Such a measurement may be used by the control means 200 to control the DA adding means 171. More in particular the control means 200 may be configured for controlling the DA adding means 171 such that the amount added results in the shear viscosity of the excess liquid developer dispersion being between 1.1 and 25 times lower, preferably between 1.5 and 15 times lower, and most preferably between 2 and 10 times lower, after adding the amount of dispersion composition.

The skilled person understands that the features of the embodiments of FIG. 2 may be combined with the features of FIG. 3. Such combinations also fall within the scope of the invention. More in particular the skilled person understands that the embodiment of FIG. 3 may further comprise a second reservoir 180 in combination with adding means 183, 184 as disclosed in FIG. 2.

It has been observed that the liquid toner properties, such as the viscosity and electrical conductivity of the remaining non used excess liquid developer dispersion are dependent upon the amount of toner and/or liquid that has been used during the development process. In case no image has to be developed, only carrier liquid with some dispersing agents has been removed from the compacted liquid toner layer. In a situation where a 50% screened image has been developed, both toner and carrier liquid have been taken out of the layer on the development roller. In a situation where a full density over the complete width has been developed, mostly only carrier liquid remains on the surface of the development roller.

Based on the considerations above, it becomes clear that in real printing conditions the remaining composition on the development roller can be predicted based on the image information. More in particular, the inventors have realized that the concentration of the dispersing agent in the excess liquid developer dispersion will be a function of the development density: more development leads to less reduction in dispersing agent concentration. Less development results in an excess liquid developer dispersion layer having a higher solid content on the surface of the development roller, with a reduced conductivity, resulting in a more viscous and more structured excess liquid developer dispersion layer. Adding an amount of dispersing agent as a function of the image content, optionally in combination with a mixing action, may increase the conductivity and reduce the viscosity, and in particular may bring the excess liquid developer dispersion in a condition showing substantially the same viscosity and conductivity behavior as the starting product.

Non-illustrated embodiments of the system of the invention may further comprise an upstream corona charger arranged opposite to a surface of the developer roller, upstream of the area of its rotational contact with the imaging roller, in order to charge the imaging particles contained in the liquid toner before reaching the imaging roller, and a downstream discharge corona, downstream of the area of contact between the developer roller and the imaging roller.

EXAMPLES

1. Test Methods 1.1 Conductivity

The conductivity is measured with a device as described in European Patent Application Publication No. EP 1120647 with an electric field strength of $1.25\times10^6$ V/m.

1.2 Viscosity

The viscosity of the liquid developer dispersion and carrier liquid is measured with a Haake Rheostress RS600 operated in shear rate sweep from 0.1 to 3000 l/s at 25° C. The instrument is equipped with a cone/plate geometry type C60/1° and the gap is set to 0.052 mm.

1.3 Particle Size Distribution

The particle size distribution is measured by a Mastersizer MS2000 from Malvern.

The milled down liquid developer dispersion is diluted before the measurement so as to obtain 10% obscuration during the measurement.

2. Results 2.1 Preparing Liquid Developer Dispersion

A liquid developer dispersion is prepared and comprises marking particles, carrier liquid and dispersing agents. The ingredients used to prepare the marking particles and the liquid developer dispersions are summarized in Table 1.

TABLE 1

| Ingredients | | | | | |
|---|---|---|---|---|---|
| | Name | Description | Acid value (mg KOH/g) | Tg(° C.) (1) | Tm(° C.) (1) |
| Polymers | PM1 | polyester resin | 12 | 60 | 99.8 |
| Additive | AD1 | toluenesulfonamide | | | |
| Pigment | PIG1 | Heliogen Blau D7079 | | | |
| | Name | Description | Base equivalent (2) | | |
| Dispersing agents | DA1 | polymeric dispersing agents with a polyethylenimine backbone and polyhydroxystearate grafts | 560-620 | | |

TABLE 1-continued

| Ingredients | | | | |
|---|---|---|---|---|
| | DA2 | statistical copolymer of vinylpyrrolidone (20%) and long chain olefins (80%) | — | |
| | Name | | viscosity 1 Hz @ 25° C. (mPas) | Conductivity (pS/cm) |
| Liquids | LIQ1 | mineral oil | 5 | 0.2 |

(1) measured according to ASTM D3418
(2) the amount of dispersing agent that is needed to neutralize 1 mol of acid The marking particles are prepared by kneading the ingredients as mentioned in Table 2 at a temperature of 100 to 120° C. for 45 minutes. This mixture is cooled down and milled down to 10 μm by a fluidized bed mill.

TABLE 2

| Composition of marking particles | | | | | | |
|---|---|---|---|---|---|---|
| Name | Polymer Name | conc (wt %) | Pigment Name | conc (wt %) | Additive Name | conc (wt %) |
| MAR1 | PM1 | 81.5 | PIG1 | 12.5 | AD1 | 6 |
| MAR2 | PM1 | 87.5 | PIG1 | 12.5 | | |

Afterwards, the liquid developer dispersions having the ingredients as described in Table 3 are prepared. A pre-dispersion of the ingredients is made and stirred for 10 min at room temperature. The pre-dispersion is than brought into the liquid milling device. The liquid developer dispersion is milled down to a dv50 of 1.5 to 2.5 μm with a bead mill. The milling was done until the desired particle size, viscosity and conductivity was obtained.

TABLE 3

| Composition of liquid developer dispersion | | | | | | |
|---|---|---|---|---|---|---|
| | Marking particles | | Dispersing agent | | Carrier liquid | |
| Name | Name | Conc (wt %) | | Conc (wt %) | | Conc (wt %) |
| LD1 | MAR1 | 35 | DA1 | 3.5 | LIQ1 | 61.5 |
| LD2 | MAR2 | 35 | DA1 | 4.2 | LIQ1 | 60.8 |

2.2 Printing Test

A printing test was performed with liquid developer dispersions LD1 and LD2 in a printer having a setup as illustrated in FIG. 2. LD1 and LD2 were first diluted to obtain a solid content of 25 wt %.

The excess liquid developer dispersion (in table 4 mentioned as LD1 and LD2 caking) was collected using removal means. A dispersion composition comprising free dispersing agent was added to the excess liquid developer dispersion, at different concentrations which can be found in Table 4. In some cases the excess liquid developer dispersion is diluted to a solid content of 25 wt % after DA1 has been added (sample 6 and 7). In other cases the excess liquid developer dispersion is concentrated by adding concentrated liquid developer dispersion to obtain a solid content of 25 wt % (sample 11, 12). The concentration of DA that is added is given in wt % with regard to the weight of excess liquid developer dispersion before it is diluted or concentrated.

TABLE 4

| Properties of collected excess liquid developer dispersion | | | | | | | |
|---|---|---|---|---|---|---|---|
| Sample | Liquid developed dispersion | Comment | Solid Content (%) | Electrical conductivity pS/cm | Rheology (mPas) 0.88/s | 7.7/s | 3000/s |
| 1 | LD1 | Starting liquid developer dispersion | 25 | 1.15 | 180.00 | 39.90 | 24.00 |
| 2 | LD1-caking | Removed caking at printing average 5-20% page coverage | 40 | 0.71 | 17500.00 | 1960.00 | 398.00 |
| 3 | LD1-diluted caking | LD1-caking diluted to 25% SC with carrier liquid | 25 | 0.56 | 1230.00 | 161.00 | 17.20 |
| 4 | LD1-caking + 0.15% DA1 | LD1-caking to which 0.15% DA1 is added | 40 | 1.61 | 1907.30 | 408.68 | 237.37 |
| 5 | LD1-caking + 0.2% DA1 | LD1-caking to which 0.2% DA1 is added | 40 | 1.9 | 845.00 | 198.00 | 125.00 |

TABLE 4-continued

| Properties of collected excess liquid developer dispersion | | | | | | | |
|---|---|---|---|---|---|---|---|
| Sample | Liquid developed dispersion | Comment | Solid Content (%) | Electrical conductivity pS/cm | Rheology (mPas) 0.88/s | 7.7/s | 3000/s |
| 6 | (LD1-caking + .15% DA1) diluted to 25% | LD1-caking to which 0.15% DA1 is added and afterward diluted to 25% SC | 25 | 1.26 | 446.00 | 79.00 | 19.00 |
| 7 | (LD1-caking + 0.2% DA1) diluted to 25% | LD1-caking to which 0.2% DA1 is added and afterward diluted to 25% SC | 25 | 1.32 | 195.00 | 43.20 | 18.50 |
| 8 | LD2 | Starting liquid developer dispersion | 25 | 1.54 | 305.00 | 47.00 | 26.00 |
| 9 | LD2-caking | Removed caking at printing average >60% page coverage | 12 | 1.62 | 173.00 | 41.00 | 19.00 |
| 10 | LD2-caking + 0.005% DA1 | LD2 caking where 0.05% DA1 is added | 12 | 1.65 | 50.00 | 32.00 | 11.00 |
| 11 | LD2 caking + LD2 concentrated liquid developer dispersion (35% SC) | LD2 caking where LD2 concentrate of 35% SC is added to achieve 25% SC | 25 | 1.72 | 550.00 | 73.00 | 33.00 |
| 12 | (LD2-caking + 0.05% DA1) + LD2 concentrated liquid developer dispersion (35% SC) | LD2-caking where LD2 concentrate of 35% SC is added to achieve 25% SC | 25 | 1.6 | 325.00 | 48.00 | 24.00 |

Table 4 shows that by adding a small amount of dispersing agent, a reduction in viscosity is obtained (compare sample 2 with sample 4 or 5). In addition, diluting the treated excess liquid developer dispersion results in a viscosity that is similar with the liquid developer dispersion (compare sample 1 with sample 7). As is clear from sample 3, diluting caked excess liquid developer dispersion without adding dispersing agent, is not enough to obtain a viscosity that is similar to the viscosity obtained in sample 1.

Furthermore, it is worth to note that the conductivity values of the treated samples tend to be the same as the conductivity value of starting liquid developer dispersion, when both samples have the same solid content (compare sample 6 and 7 with sample 1).

Furthermore, Table 4 shows that when a high image coverage is printed, the solid content of excess liquid developer dispersion is lower than 25% (sample 9). The viscosity of the excess liquid developer dispersion is in this case lower than the viscosity of the starting liquid developer dispersion because the solid content of the excess liquid developer dispersion is very low. The caking of the low content excess liquid developer dispersion LD2 can be significantly reduced by adding 0.05% DA1 (compare sample 9 and 10). Concentration of the treated excess liquid developer dispersion by adding concentrated liquid developer dispersion with a solid content of 35% to obtain a solid content of 25%, results in a viscosity that is similar with the viscosity of starting liquid developer dispersion (compare sample 8 and 12). The addition of concentrated LD2 to the caked excess liquid developing dispersion that is not treated, does not reduce the caking problem and results in an increase of viscosity due to the increase of solid content (compare sample 8 with 11).

The invention claimed is:

1. A method for the reduction of caking of excess liquid developer dispersion that remains present on the surface of a member after transfer of liquid developer dispersion from one member to another member in a digital printing apparatus, comprising the step of adding a dispersing composition to the excess liquid developer dispersion by a dispersing agent adding means, wherein the dispersing composition comprises a free dispersing agent;

wherein liquid developer is stored in a liquid developer dispersion reservoir for feeding a toner supply member of the digital printing apparatus; and wherein the excess liquid developer dispersion is collected in a reservoir, and wherein the adding means are arranged for adding an amount of dispersing agent to said reservoir and/or wherein the adding means are arranged for adding an amount of dispersing agent to the excess liquid developer dispersion before or after it is removed from the member; and wherein the adding by the dispersing agent adding means is controlled by a controller which determines a suitable amount of dispersion composition to be added; and wherein the excess liquid developer dispersion with the added dispersing composition is returned to the liquid developer dispersion reservoir.

2. Method according to claim 1, wherein the step of adding free dispersion agent is performed during printing.

3. Method according to claim 1, wherein the excess liquid developer dispersion is removed from the member before adding the dispersing composition.

4. Method according to claim 1, wherein the free dispersing agent is added with an amount that is sufficient to obtain a concentration between 0.005 wt % and 0.5 wt %, preferably between 0.01 wt % and 0.3 wt %, and most preferably between 0.02 wt % and 0.2 wt % of free added dispersing agent with regard to the total weight of excess liquid developer dispersion.

5. Method according to claim 1, wherein the dispersing agent is selected from the group consisting of polymeric dispersing agents with a polyethylenimine or polyallylamine backbone and polyhydroxystearate and/or polycaprolactone grafts; statistical copolymer of vinylpyrrolidone and long chain olefins.

6. Method according to claim 1, wherein the amount of the dispersing agent in the dispersing composition that is added is sufficient to provide a lower viscosity to the excess liquid developer dispersion compared to the viscosity of the excess liquid developer dispersion where no dispersing agent is added.

7. Method according to claim 6, wherein the viscosity is between 1.1 and 25 times lower, preferably between 1.5 and 15 times lower and most preferably between 2 and 10 times lower compared to the viscosity of untreated excess liquid developer dispersion when the viscosity is measured at 25° C. at a shear rate of 0.88 l/s.

8. Method according to claim 1, comprising the step of collecting excess liquid developer dispersion and the step of mixing the collected excess liquid developer dispersion with the added dispersing composition.

9. A method for the reduction of caking of excess liquid developer dispersion that remains present on the surface of a member after transfer of liquid developer dispersion from one member to another member in a digital printing apparatus, comprising the step of adding a dispersing composition to the excess liquid developer dispersion, wherein the dispersing composition comprises a free dispersing agent;

wherein the method further comprises the step of determining an amount of dispersing composition to be added to reduce caking of excess liquid developer dispersion, wherein the adding comprises adding the determined amount;

wherein a viscosity of the excess liquid developer dispersion is measured, and determining an amount of dispersing composition to be added is based on the measured viscosity.

10. A method for the reduction of caking of excess liquid developer dispersion that remains present on the surface of a member after transfer of liquid developer dispersion from one member to another member in a digital printing apparatus, comprising the step of adding a dispersing composition to the excess liquid developer dispersion, wherein the dispersing composition comprises a free dispersing agent;

wherein the method further comprises collecting image information about an image that is being printed in the digital printing apparatus; the image information being representative for the fraction of liquid developer dispersion that is being developed; and determining an amount of dispersion composition to be added based on the collected image information;

wherein the adding of the dispersion composition comprises adding the determined amount of dispersion composition.

11. A method for the reduction of caking of excess liquid developer dispersion that remains present on the surface of a member after transfer of liquid developer dispersion from one member to another member in a digital printing apparatus, comprising the step of adding a dispersing composition to the excess liquid developer dispersion during printing, wherein the dispersing composition comprises a free dispersing agent, and wherein the excess liquid developer dispersion is removed from the member before adding the dispersing composition.

12. Digital printing system comprising:

a first member in rotational contact with a second member; the first and second member being configured for transferring liquid developer dispersion from the first member to the second member, such that an excess liquid developer dispersion remains present on the surface of the first member after transfer of liquid developer dispersion to the second member;

adding means configured for adding an amount of free dispersing agent to the excess liquid developer dispersion; and control means for controlling the adding means such that the amount added is sufficient to reduce caking in the excess liquid developer dispersion;

a liquid developer dispersion reservoir for storing liquid developer; wherein the system is configured to return the excess liquid developer dispersion with the added dispersing composition to said liquid developer dispersion reservoir;

a toner supply member for feeding the first member with liquid developer from the liquid developer dispersion reservoir;

a reservoir adapted for collecting the excess liquid developer dispersion; and wherein the adding means are configured to add an amount of dispersing agent to said reservoir and/or wherein the adding means are arranged for adding an amount of dispersing agent to the excess liquid developer dispersion before or after it is removed from the member.

13. Digital printing system of claim 12, wherein the adding means are configured for adding an amount of free dispersing agent during printing.

14. Digital printing system of claim 12, wherein the control means are configured for controlling the adding means such that an amount of free dispersing agent added results in the viscosity of the excess liquid developer dispersion being between 1.1 and 25 times lower, preferably between 1.5 and 15 times lower, and most preferably between 2 and 10 times lower, when the viscosity is measured at 25° C. at a shear rate of 0.88 l/s.

15. Digital printing system of claim 12, further comprising collecting and determining means configured for collecting image information about an image that is being printed in the digital printing system; the image information being representative for the fraction of liquid developer dispersion that is being developed on the development roller; and for determining an amount of dispersion agent to be added based on the collected image information; wherein the control means are configured for controlling the adding means using the determined amount of dispersion agent to be added.

16. Digital printing system of claim 12, wherein the second member is an imaging member adapted to sustain a pattern of electric charge forming a latent image on its surface, wherein the first member is a development member arranged to receive a quantity of liquid developer dispersion, and to develop the latent image by transferring a portion of the quantity of liquid developer dispersion onto the imaging member in accordance with the pattern.

17. Digital printing system of claim 12, further comprising a viscosity sensor for measuring the viscosity of the excess liquid developer dispersion, wherein the control means are configured for controlling the adding means on the basis of the measured viscosity.

18. Digital printing system of claim 12, wherein the adding means are arranged for adding an amount of dispersing agent in the first reservoir.

19. Digital printing system of claim 18, further comprising:

a second reservoir adapted for collecting the excess liquid developer solution in which the amount of dispersing agent is added;

carrier liquid adding means arranged for adding an amount of carrier liquid in the second reservoir;

toner concentrate adding means arranged for adding an amount of toner concentrate in the second reservoir;

the second reservoir being connected to the liquid developer dispersion reservoir for returning recycled developer dispersion to the liquid developer dispersion reservoir.

* * * * *